US011219286B2

(12) United States Patent
Cox

(10) Patent No.: US 11,219,286 B2
(45) Date of Patent: Jan. 11, 2022

(54) CANOPY UMBRELLA

(71) Applicant: LSO, LP, San Diego, CA (US)

(72) Inventor: Brian Cox, San Diego, CA (US)

(73) Assignee: LSO, LP, San Diego, CA (US)

( * ) Notice: Subject to any disclaimer, the term of this patent is extended or adjusted under 35 U.S.C. 154(b) by 0 days.

(21) Appl. No.: 16/646,797

(22) PCT Filed: Sep. 13, 2018

(86) PCT No.: PCT/US2018/050816
§ 371 (c)(1),
(2) Date: Mar. 12, 2020

(87) PCT Pub. No.: WO2019/055608
PCT Pub. Date: Mar. 21, 2019

(65) Prior Publication Data

US 2020/0221835 A1 Jul. 16, 2020

Related U.S. Application Data

(60) Provisional application No. 62/558,559, filed on Sep. 14, 2017.

(51) Int. Cl.
*A45B 11/00* (2006.01)
*A45B 23/00* (2006.01)
(Continued)

(52) U.S. Cl.
CPC ..... *A45B 11/00* (2013.01); *A45B 23/00* (2013.01); *A45B 25/20* (2013.01); *E04H 15/14* (2013.01);
(Continued)

(58) Field of Classification Search
CPC ..... A45B 2011/005; A45B 2023/0093; A45B 11/00; A45B 2200/1072;
(Continued)

(56) References Cited

U.S. PATENT DOCUMENTS 3,070,107 A * 12/1962 Beatty ..... E04H 15/003 135/87
4,086,931 A * 5/1978 Hall ..... E04H 15/001 135/98
(Continued)

FOREIGN PATENT DOCUMENTS

DE 102012023095 A1 * 5/2014 ..... A45B 25/00
FR 1596907 A * 6/1970 ..... A45B 19/02
GB 2284437 A * 6/1995 ..... E04H 15/28

*Primary Examiner* — David R Dunn
*Assistant Examiner* — Danielle Jackson
(74) *Attorney, Agent, or Firm* — Norman E. Lehrer

(57) ABSTRACT

A combined umbrella and canopy (10) that provides the advantages of both of these devices for providing maximum shade. The umbrella portion (12) is substantially similar to a standard beach umbrella having a vertical pole (16) with spokes or ribs (22, 24, 26, 28) extending radially outwardly adjacent the top (20) for supporting a fabric cover (30). The fabric cover (30) defines a front (32) and back (34) and at least two sides of the umbrella. The back (34) of the umbrella includes an additional length of fabric (36) that extends horizontally rearwardly and then curves downwardly and terminates in two spaced apart ends (38, 40). Each end includes a pocket (42, 44) that can be filled with sand to weigh the same down to maintain the ends on the beach. The additional fabric (36) is essentially a canopy (14). The umbrella structure (12) provides better support for the forward end of the canopy and prevents the same from collapsing when the wind conditions change.

16 Claims, 5 Drawing Sheets

(51) Int. Cl.
*A45B 25/20* (2006.01)
*E04H 15/14* (2006.01)
*E04H 15/28* (2006.01)

(52) U.S. Cl.
CPC ..... *E04H 15/28* (2013.01); *A45B 2011/005* (2013.01); *A45B 2023/0012* (2013.01); *A45B 2200/1036* (2013.01); *A45B 2200/1072* (2013.01)

(58) Field of Classification Search
CPC ..... A45B 2200/1036; E04H 15/005; E04H 15/003; E04H 15/26; E04H 15/28
See application file for complete search history.

(56) References Cited

U.S. PATENT DOCUMENTS 4,930,534 A * 6/1990 Hill ..... E04H 15/003 135/117
4,971,090 A * 11/1990 Uhl ..... A45B 23/00 135/98
5,080,123 A * 1/1992 Stein ..... E04H 15/003 135/114
5,546,971 A * 8/1996 Leonhardt ..... E04H 15/003 135/127
7,493,908 B2 * 2/2009 Carter ..... A45B 11/00 135/16
7,793,674 B2 * 9/2010 Elder ..... A45B 25/20 135/33.2
9,051,756 B1 * 6/2015 Jenkins ..... E04H 15/003
2005/0011134 A1 * 1/2005 Boltan ..... E04H 15/003 52/3
2012/0291830 A1 * 11/2012 Crimi ..... E04H 15/58 135/117

* cited by examiner

CANOPY UMBRELLA

TECHNICAL FIELD

The present invention is directed toward a combined umbrella and canopy or sun/shade which is primarily useful at the beach for protecting beachgoers from direct sunlight. It is, however, not limited to use at the beach and can be used in substantially any outdoor environment where protection from the sun is desired.

BACKGROUND ART

Umbrellas have been used on the beach for many years to shade people from the sun. While there have been variations over the years, they have essentially stayed the same. A beach umbrella includes a vertical central pole that supports a number of radially extending spokes or ribs near the top thereof which, in turn, support a fabric top. As is well known in the art, the spokes or ribs and the fabric top can be collapsed for easy handling and storage and are easily erected when it is desired to use the same. Umbrellas are useful but are relatively small, thereby providing very little shade.

Sun canopies for use at the beach for protection from the sun are also well known. Examples are shown in U.S. Pat. No. 9,051,756 and U.S. Published Patent Application Nos. 2012/0291830 and 2014/0041703. The entire contents of each of these prior documents are incorporated herein by reference.

In each of these prior art canopy devices, the forward end thereof is held up in place by a vertical pole that is inserted into the ground. The top of the vertical pole includes a horizontally extending cross beam that supports the fabric from which the canopy is made. In each case, the cross beam is perfectly straight. Each of these prior art devices also includes pockets at the far end into which sand can be placed to weigh them down. Furthermore, the canopy is made essentially of a single piece of fabric.

While these prior art devices may be somewhat useful and, under the right conditions, can provide more shade from the sun than many umbrellas, they require that there be wind, that the wind be relatively steady and that the wind come from the proper direction. Any shift in the wind or any temporary loss of wind may cause the canopy to collapse.

A need exists, therefore, for a beach canopy that is not fully dependent on the direction of the wind and that does not necessarily need to be reoriented each time that there is a shift in the wind direction.

SUMMARY OF THE INVENTION

The present invention is designed to overcome the deficiencies of the prior art discussed above. It is an object of the present invention to provide a beach or shade canopy that will protect a person from the harmful rays of the sun.

It is another object of the present invention to provide such a canopy that is not fully dependent on the direction of the wind.

It is a still further object of the present invention to provide such a canopy that need not be rearranged each time that there is a change in the wind direction.

It is an even further object of the present invention to provide such a canopy that will provide shade for the user even in the absence of wind.

In accordance with the illustrative embodiment demonstrating features and advantages of the present invention, there is provided a combined umbrella and canopy that provides the advantages of both of these devices. The umbrella portion is substantially similar to a standard beach umbrella having a vertical pole with spokes or ribs extending radially outwardly adjacent the top of the pole for supporting a fabric top or cover. The fabric umbrella top defines a front and back and at least two sides of the umbrella. The back of the umbrella includes an additional length of fabric that extends horizontally rearwardly and then curves downwardly and terminates in two spaced apart ends. Each end includes a pocket that can be filled with sand to weigh the same down and to maintain the ends on the beach. The additional fabric is essentially a canopy. The umbrella structure provides better support for the forward end of the canopy and prevents the same from collapsing when the wind conditions change.

Other objects, features, and advantages of the invention will be readily apparent from the following detailed description of the preferred embodiment thereof taken in conjunction with the drawings.

DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
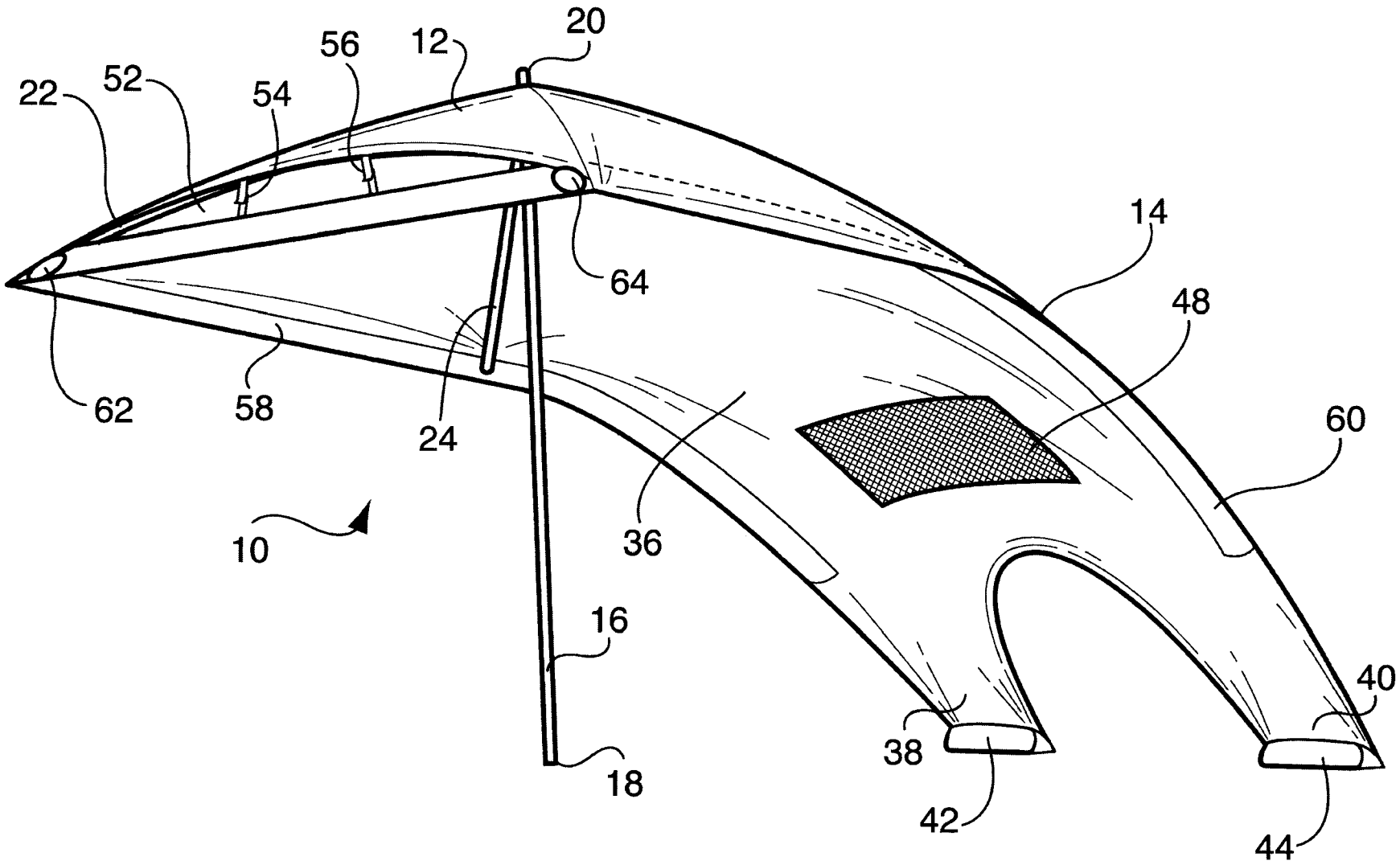
FIG. 1 is a front perspective view of the combined umbrella and sun canopy of my invention.
Figure 2:
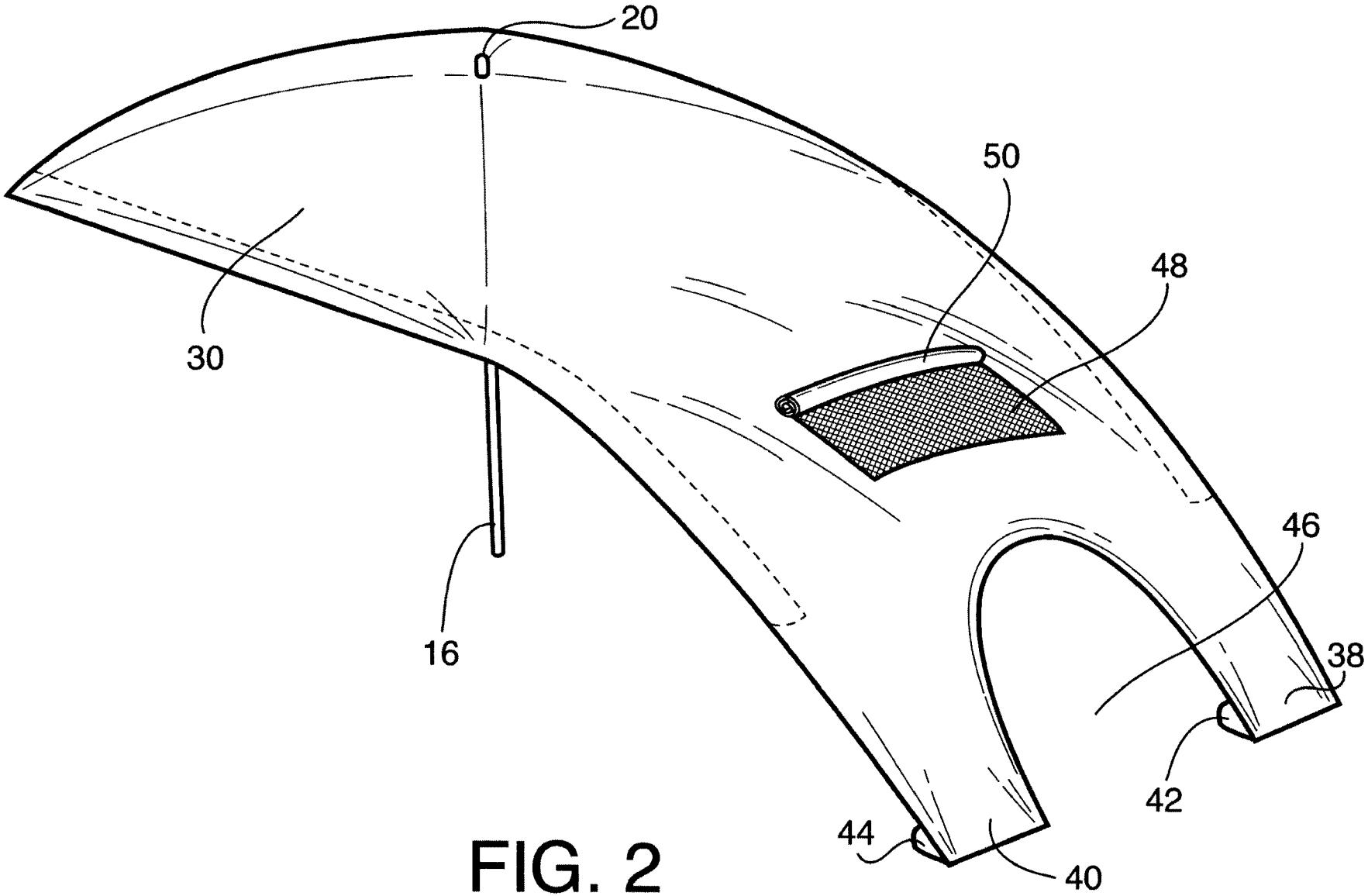
FIG. 2 is a rear perspective view thereof.
Figure 3:
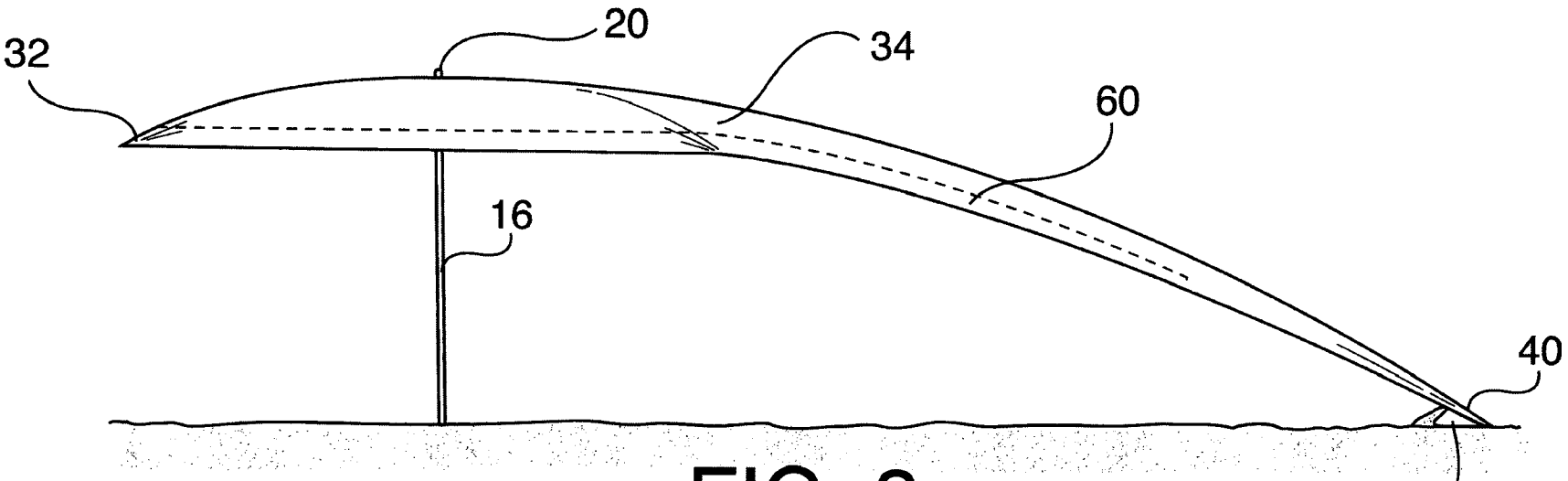
FIG. 3 is a side elevational view thereof.
Figure 5:
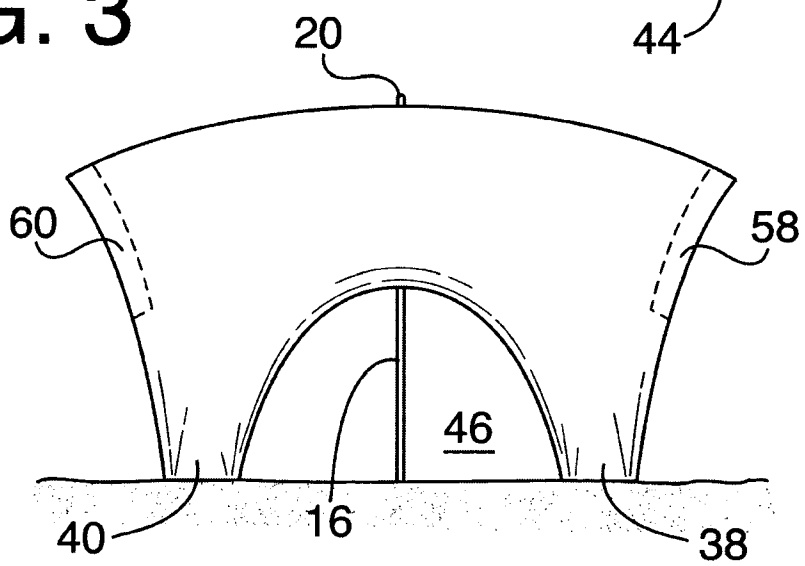
FIG. 5 is a rear elevational view thereof.
Figure 4:
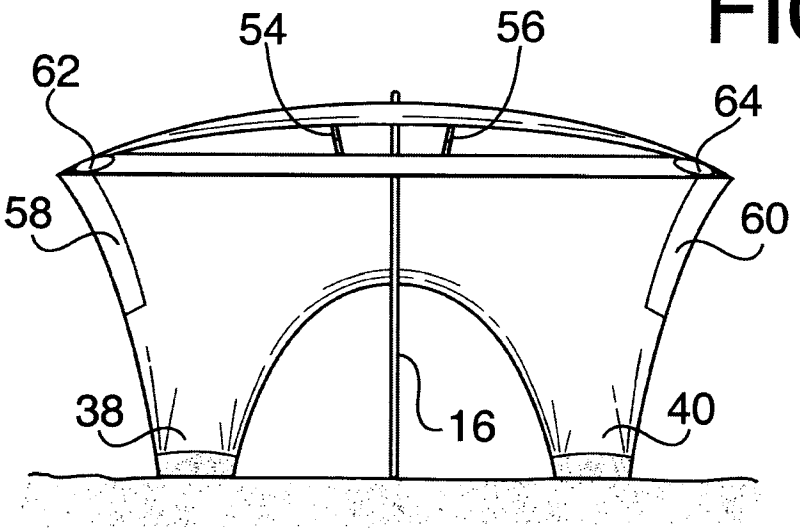
FIG. 4 is a front elevational view thereof.
Figure 6:
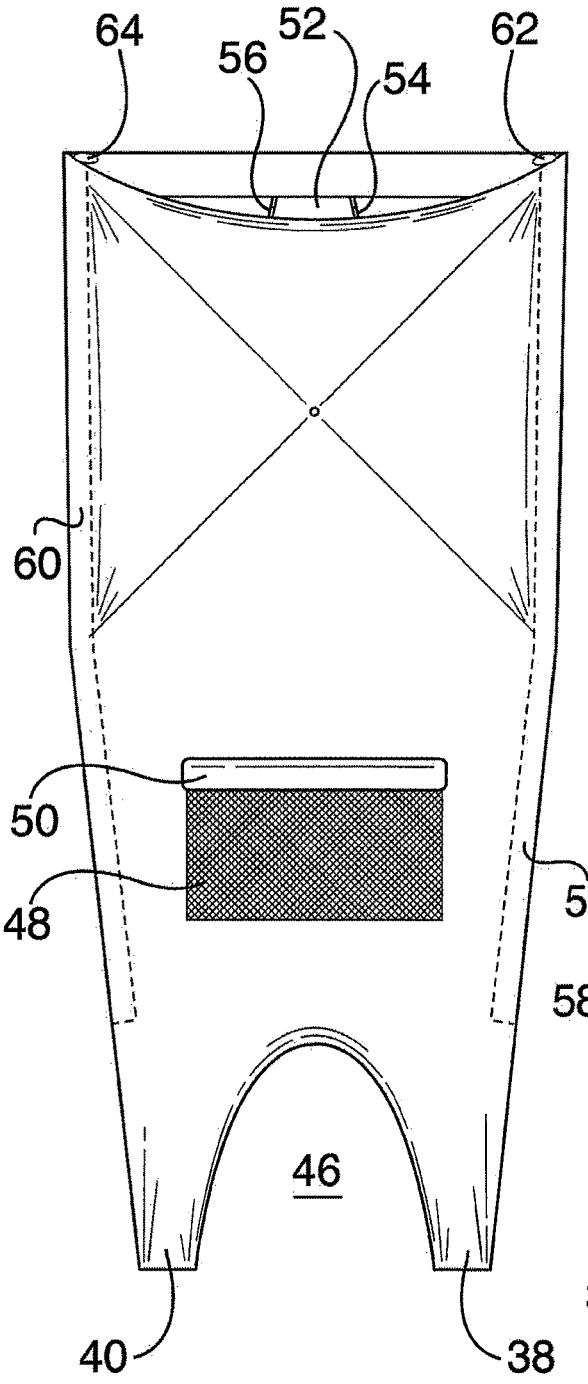
FIG. 6 is a top plan view of the combined umbrella and sun canopy.
Figure 7:
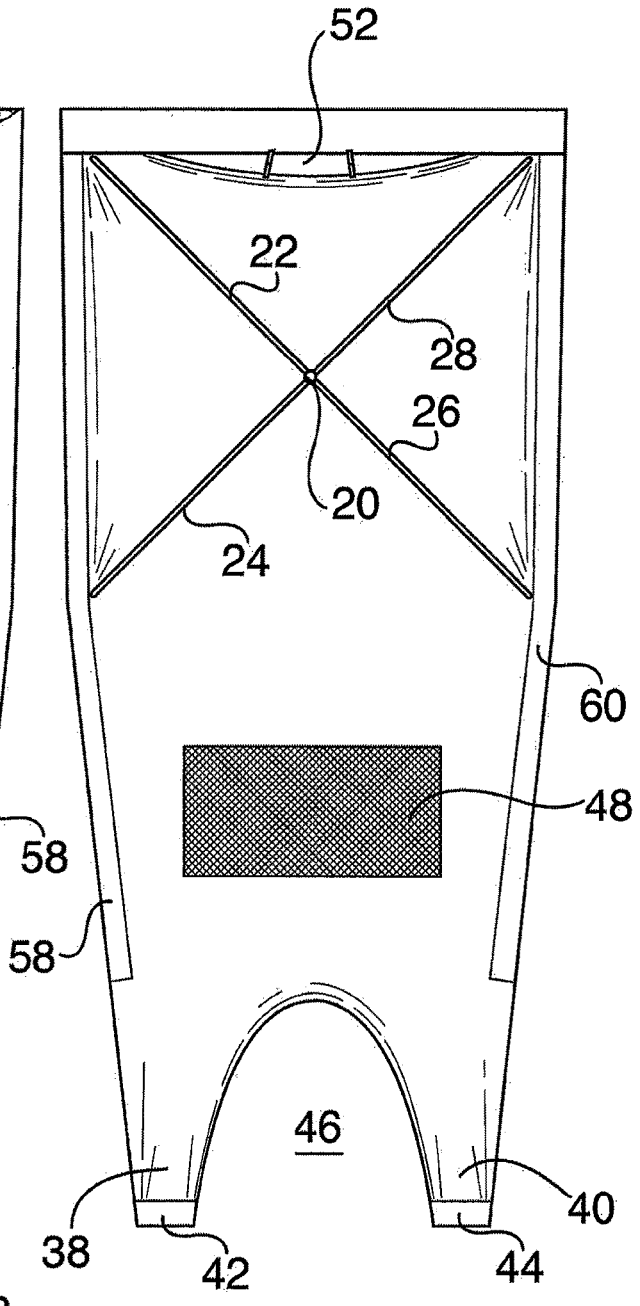
FIG. 7 is a bottom plan view thereof.

Referring now to the drawings in detail wherein like reference numerals have been used throughout the various figures to designate like elements, there is shown in FIGS. 1-8 a canopy umbrella constructed in accordance with the principles of the present invention and designated generally as 10.

The canopy umbrella 10 is comprised essentially of two parts: an umbrella portion 12 and a canopy portion 14. The umbrella portion 12 is essentially the same as a conventional beach umbrella. Accordingly, it is not believed that a detailed description of the same is necessary. In summary, the umbrella portion 12 includes an elongated vertically extending pole 16 having a lower end 18 and an upper end 20. The lower end 18 is intended to be inserted into the ground to maintain the pole 16 in an essentially vertical orientation.

Figure 8:
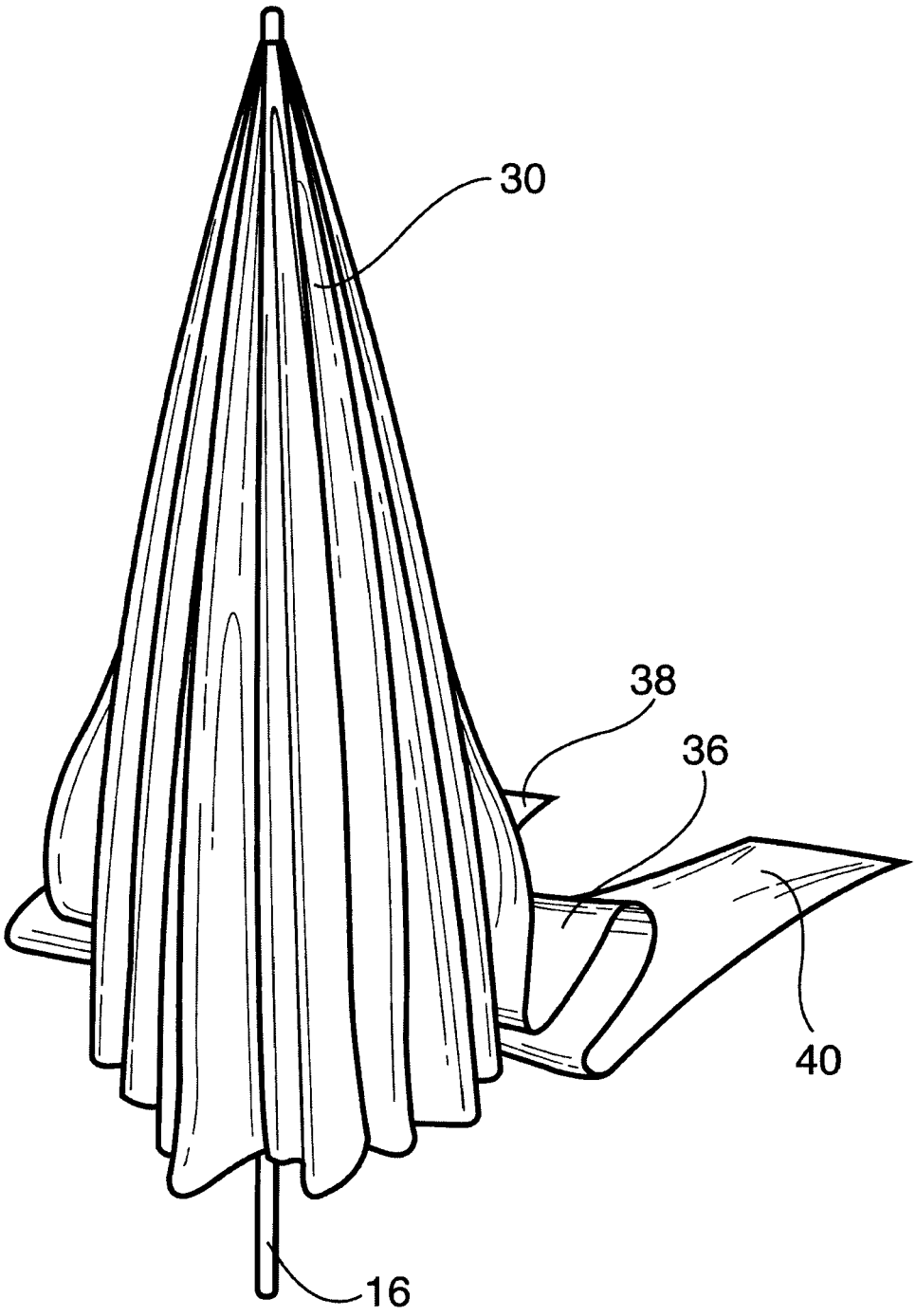
FIG. 8 illustrates how the structure collapses or folds like a conventional umbrella.

In the embodiment of the invention shown in the drawings, four spokes or ribs 22, 24, 26 and 28 are connected to the upper end 20 of the pole 16. As is also known in the art, they are hingedly secured thereto so as to be movable between a closed position such as shown in FIG. 8 wherein they hang substantially downwardly parallel to the pole and an open position wherein the spokes extend radially outwardly from the pole as shown in the remaining figures.

Although four spokes or ribs are shown in the drawings, it should be readily apparent to those skilled in the art that substantially any number of ribs greater than two can be utilized. Conventional beach umbrellas traditionally have at least four ribs and preferably six or eight. In any event, the present invention is applicable to all of these.

As is also well known in the art, fabric material 30 overlies and covers the spokes 22, 24, 26 and 28. The fabric material 30 is maintained in place by the ends of the spokes as is conventional in the art.

The two spokes 22 and 28 and the portion of the fabric material 30 attached to the ends of those two spokes define the front 32 of the umbrella portion 12. The ends of the spokes 24 and 26 that support the fabric material 30 and the fabric material attached thereto define the back 34 of the umbrella portion.

Thus far, the invention described is essentially a standard beach umbrella. However, the present invention is not limited thereto. For example, the umbrella need not be symmetrical as shown but could be asymmetrical wherein the pole 16 is off center such as shown in U.S. Pat. Nos. 5,505,221 and 7,350,530. Furthermore, additional adjustable radial struts or ribs could be utilized to change the shape of the cover 30. This might be done, for example, to provide a more aggressive front or leading edge or to relax or flatten the leading edge or shorten the trailing edge or to make other adjustments. During certain wind conditions, such adjustments may be helpful to improve airflow and provide lift for the canopy. In any case, the canopy portion 14 of the canopy umbrella of the present invention is attached to the umbrella portion 12.

The canopy portion 14 is essentially an additional length of fabric material 36 that extends substantially horizontally and rearwardly from the back 34 of the umbrella portion 12 when the umbrella portion is in its open position. The additional length of material 36 then curves downwardly and terminates in two spaced apart ends 38 and 40 on the ground. Pockets 42 and 44 can be filled with sand in order to maintain the ends 38 and 40 in place on the ground.

While the additional length of fabric material 36 shown in the drawings is a continuation of the fabric material 30, it is not beyond the scope of the present invention to use a separate material that is sewn or otherwise attached to the fabric material 30. In any event, there is preferably an opening 46 at the lower end of the canopy section 14 in order to allow air to flow therethrough. In addition, located in the middle of the canopy portion 14 is a screen 48 which can also be used to allow air to flow therethrough. A rolled up fabric shade 50 can be rolled down to cover the screen 48, when desired.

In order to assist air into the front of the umbrella portion 12 to lift the canopy portion 14, a horizontal slit 52 is formed in the fabric material 30 at the front 32 of the umbrella portion. This slit 52 can be closed when desired and/or the size of the slit can be adjusted utilizing the pair of hook and pile straps 54 and 56.

As a further way of assisting the combined umbrella and canopy 10 to maintain its shape, the sides of the fabric material 30 are folded over onto each other to form elongated tubes 58 and 60. These tubes are open at their forward ends as shown at 62 and 64 and are also open at their back ends so that air can pass therethrough to help shape the canopy portion 14.

The present invention may be embodied in other specific forms without departing from the spirit or essential attributes thereof and accordingly, reference should be made to the appended claims rather than to the foregoing specification as indicating the scope of the invention.

The invention claimed is:

1. A canopy umbrella comprising:

an umbrella portion having an elongated vertically extending pole having a lower end and an upper end, said lower end being adapted to be inserted into the ground to maintain said pole in an essentially vertical orientation;

at least four spokes connected to said upper end of said pole and being movable between a closed position wherein they hang downwardly parallel to said pole and an open position wherein said spokes extend radially outwardly from said pole;

fabric material overlying and covering said spokes;

two of said spokes and a portion of said fabric material defining the front of said canopy umbrella and two different spokes and a different portion of said fabric material defining the back of said canopy umbrella, and a canopy portion comprised of an additional length of fabric material extending substantially horizontally and rearwardly from said back of said umbrella portion when said spokes are in their open position, said additional length of material then curving downwardly and terminating in two spaced apart ends.

2. The canopy umbrella as claimed in claim 1 including an opening between said spaced apart ends to allow air to pass therethrough.

3. The canopy umbrella as claimed in claim 2 including means for maintaining said ends on the ground.

4. The canopy umbrella as claimed in claim 3 wherein said means for maintaining said ends on the ground includes pockets in said ends into which heavy material can be inserted.

5. The canopy umbrella as claimed in claim 2 including a horizontal slit formed in the fabric material in the front of said umbrella portion to form an elongated opening which allows air to pass therethrough.

6. The canopy umbrella as claimed in claim 5 including means for closing said opening formed by said slit.

7. The canopy umbrella as claimed in claim 5 including means for adjusting the size of said opening formed by said slit.

8. The canopy umbrella as claimed in claim 2 wherein the additional length of fabric material also defines two sides, said sides including tubes therein that extend from said front of said umbrella portion and through said canopy portion and are so constructed and arranged that air can pass therethrough.

9. The canopy umbrella as claimed in claim 8 wherein said tubes are formed by folding edges of said additional length of fabric material fabric over themselves.

10. The canopy umbrella as claimed in claim 1 wherein said canopy portion includes a screen therein.

11. The canopy umbrella as claimed in claim 10 including a cover for said screen.

12. A canopy umbrella comprising:

an umbrella portion having an elongated vertically extending pole having a lower end and an upper end, said lower end being adapted to be inserted into the ground to maintain said pole in an essentially vertical orientation;

at least four spokes connected to said upper end of said pole and being movable between a closed position wherein they hang downwardly parallel to said pole and an open position wherein said spokes extend radially outwardly from said pole;

fabric material overlying and covering said spokes;

two of said spokes and a portion of said fabric material defining the front of said canopy umbrella and two different spokes and a different portion of said fabric material defining the back of said canopy umbrella;

a horizontal slit formed in the fabric material in the front of said umbrella portion to form an elongated opening which allows air to pass therethrough, and a canopy portion comprised of an additional length of fabric material extending substantially horizontally and rearwardly from said back of said umbrella portion when said spokes are in their open position, said additional length of material then curving downwardly and terminating in two spaced apart ends.

13. The canopy umbrella as claimed in claim 12 including means for closing said opening formed by said slit.

14. The canopy umbrella as claimed in claim 12 including means for adjusting the size of said opening formed by said slit.

15. A canopy umbrella comprising:

an umbrella portion having an elongated vertically extending pole having a lower end and an upper end, said lower end being adapted to be inserted into the ground to maintain said pole in an essentially vertical orientation;

at least four spokes connected to said upper end of said pole and being movable between a closed position wherein they hang downwardly parallel to said pole and an open position wherein said spokes extend radially outwardly from said pole;

fabric material overlying and covering said spokes;

two of said spokes and a portion of said fabric material defining the front of said canopy umbrella and two different spokes and a different portion of said fabric material defining the back of said canopy umbrella;

a canopy portion comprised of an additional length of fabric material extending substantially horizontally and rearwardly from said back of said umbrella portion when said spokes are in their open position, said additional length of material then curving downwardly and terminating in two spaced apart ends, and wherein the additional length of fabric material defines two sides, said sides including tubes therein that extend from said front of said umbrella portion and through said canopy portion and are so constructed and arranged that air can pass therethrough.

16. The canopy umbrella as claimed in claim 15 wherein said tubes are formed by folding edges of said additional length of fabric material over themselves.

* * * * *